US006916202B2

(12) United States Patent
Maue et al.

(10) Patent No.: US 6,916,202 B2
(45) Date of Patent: Jul. 12, 2005

(54) ELECTRIC PLUG-IN CONNECTION

(75) Inventors: Hans-Heinrich Maue, Bietigheim-Bissingen (DE); Werner Hofmeister, Muehlacker (DE); Michael Schoenfeld, Leinfelden-Echterdingen (DE); Andreas Simmel, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 153 days.

(21) Appl. No.: 10/009,243

(22) PCT Filed: Mar. 24, 2001

(86) PCT No.: PCT/DE01/01147

§ 371 (c)(1),
(2), (4) Date: Apr. 25, 2002

(87) PCT Pub. No.: WO01/78198

PCT Pub. Date: Oct. 18, 2001

(65) Prior Publication Data

US 2003/0166359 A1 Sep. 4, 2003

(30) Foreign Application Priority Data

Apr. 8, 2000 (DE) ..... 200 06 550 U

(51) Int. Cl.[7] ..... H01R 13/40
(52) U.S. Cl. ..... 439/587

(58) Field of Search ..... 439/587, 275, 439/589, 274, 279, 277, 281, 282

(56) References Cited

U.S. PATENT DOCUMENTS

| | | | | |
|---|---|---|---|---|
| 4,705,339 A | | 11/1987 | Cooper et al. | |
| 5,830,011 A | * | 11/1998 | Wood | 439/587 |
| 5,931,699 A | * | 8/1999 | Saito | 439/587 |
| 2002/0052140 A1 | * | 5/2002 | Hara et al. | 439/587 |

FOREIGN PATENT DOCUMENTS

| | | |
|---|---|---|
| DE | 41 15 119 | 11/1992 |
| DE | 42 38 321 | 5/1994 |

* cited by examiner

*Primary Examiner*—J. F. Duverne
(74) *Attorney, Agent, or Firm*—Kenyon & Kenyon

(57) ABSTRACT

A multipole electrical plug connection remains functionally stable even under vibrational stresses, in particular during the operation of an internal combustion engine. The plug connection is formed by coupling a first connector to a second connector. Attached to a contact carrier as part of a housing of the first connector are a first pressing element and a second pressing element, via which the two connectors are radially and axially biased when both connectors are joined. As a result, relative movements between the contacted contact elements and contact parts situated in the fixed connectors are prevented. The plug connection is preferably intended for use in automobile manufacturing.

6 Claims, 2 Drawing Sheets

ELECTRIC PLUG-IN CONNECTION

BACKGROUND INFORMATION

An electrical plug connection having two connectors that can be detachably coupled to one another is known from German Patent No. DE 41 15 119.

The first connector has a contact carrier. Formed in the contact carrier are receiving chambers in which in each case one contact element is located. The contact elements are each connected via a connection segment to a cable. Clustered as a cable harness, the cables are brought out of the first connector on the reverse side. In a closed plug connection, the contact elements are electroconductively connected via contact segments to the appropriate contact parts of the second connector.

To seal the plug connection between the connectors, a sealing ring of an elastic material runs around the outside of the contact carrier of the first connector, the sealing ring engaging with a side surface of a sleeve-shaped flange of the second connector and deforming in a resilient manner when the two connectors are joined.

If such a plug connection is used in a motor vehicle, the connection is stressed during the operation of the motor vehicle by vibrational stresses, and relative movements occur between the two connectors since they are elastically coupled via the seal. These relative movements also occur between the contact elements of the first connector and the contact parts of the second connector, and they can result in the touching contact surfaces of the contact elements and the contact parts wearing through. The contacting is then carried out via the less effective contacting carrier material of these elements, thereby no longer ensuring the contact reliability of the plug connection. As a result, the performance reliability of the plug connection is undesirably affected.

SUMMARY OF THE INVENTION

The plug connection according to the present invention has the advantage that the previously mentioned shortcomings are avoided.

For this purpose, a first pressing element, which is radially pressed against the flange of the mating connector, as well as a second pressing element, which receives an end face of the flange under an axially directed pressing tension at the end of the coupling process of the two connectors, are attached to the first connector in addition to the sealing element. The clearance of motion that was unavoidable in the case of the related art due to the deformability of the sealing element needed for functionality is eliminated by the pressing elements. As a result, the two:connectors behave in a coupled state as if they were one piece. This transfers to the contact elements and contact parts situated in the fixed connectors, thereby producing a stable connection.

Due to this formation of the connectors, the vibrational stresses introduced to the contact elements and contact parts are advantageously reduced to the extent that they no longer jeopardize the functionality of the plug connection.

DETAILED DESCRIPTION

Figure 1:
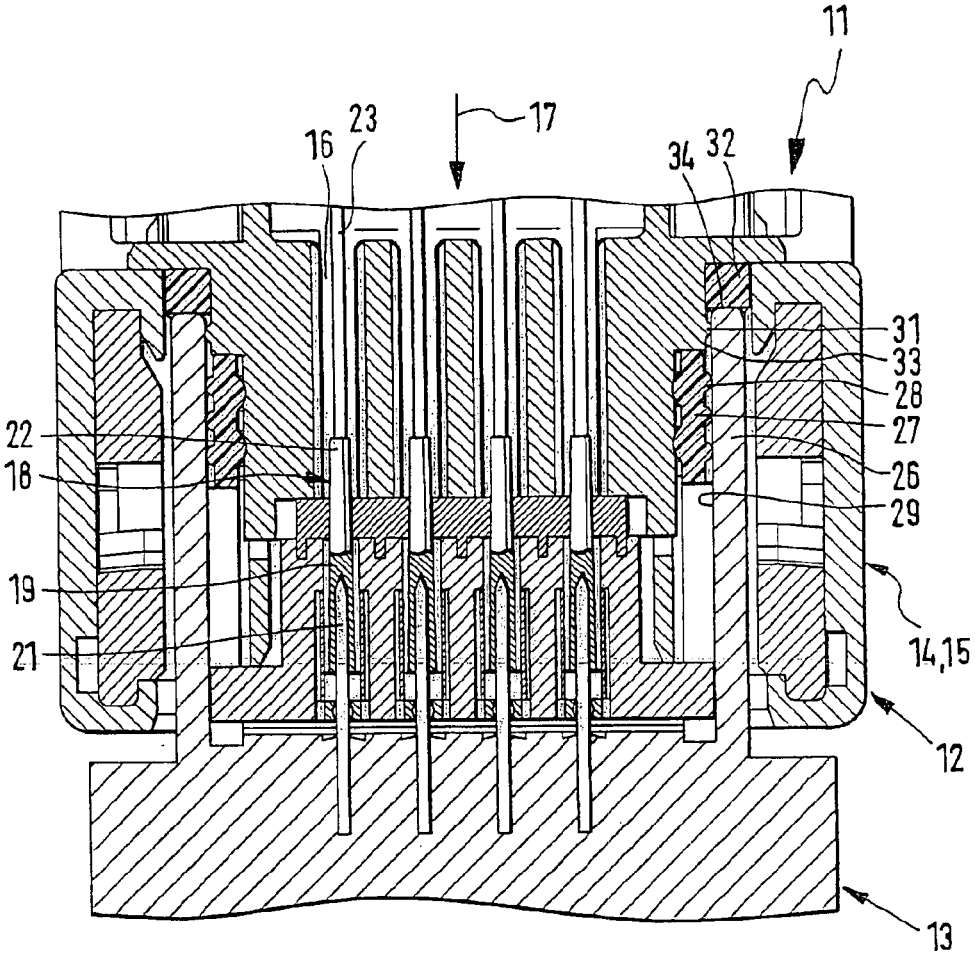
FIG. 1 shows a sectional view of a first connector coupled with a second connector to form an electrical plug connection.
Figure 2:
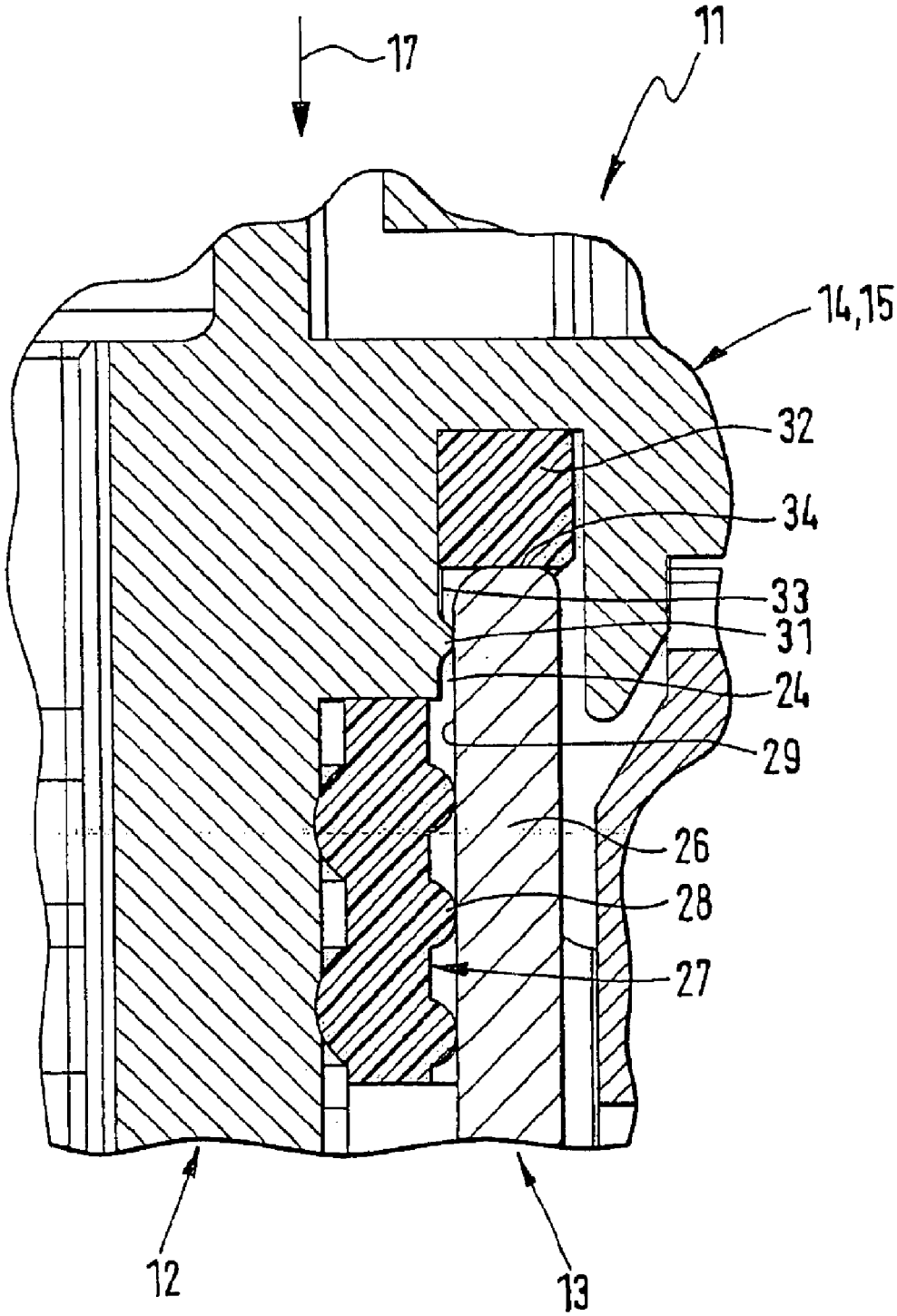
FIG. 2 shows an enlarged section of FIG. 1.

An electrical plug connection 11 shown in FIGS. 1 and 2 has a first connector 12 and a second connector 13. First connector 12 is configured as a movable cable-harness plug, while second connector 13 is attached in a stationary manner as a attachment plug to an electrical aggregate, in particular to a diesel injection pump. Connectors 12,13 are detachably coupled to one another.

First connector 12 has a housing 14 formed as a grip-type shell, which is formed as a contact carrier 15 on the inside. As the rest of housing 14, contact carrier 15 is made of an electrically insulating plastic and includes a number of receiving chambers 16 corresponding to the pole number of first connector 12, the receiving chambers penetrating contact carrier 15 in the axial direction, along an arrow 17. Inserted in the direction of arrow 17 in every receiving chamber 16 is a contact element 18, which is only schematically represented.

At one end, contact element 18 has a contact segment 19, via which contact element 18 contacts an associated contact part 21 of second connector 13. Formed at the other end of contact element 18 is a fastening segment 22, to which an electric cable 23 is attached in an electrically contacting manner, the cable, upon emerging from contact carrier 14, being combined in a manner not shown with the other cables of the other contact elements 18 to form a cable harness.

Formed in contact carrier 15 as part of housing 14 is an axially directed, circumferential receiving slot 24 for accommodating an end segment of a corresponding flange 26 of second connector 13 when joining both connectors 12, 13. To seal plug connection 11 between connectors 12, 13, a seal 27 is attached to contact carrier 15.

To form a radial seal, seal 27 has a plurality of circumferential, radially directed sealing lips 28, which are axially offset from one another.

When joining both connectors 12, 13, sealing lips 28 are gripped by sleeve-shaped flange 26 of second connector 13 and are partially resiliently deflected at a side surface 29 of flange 26 in the axial direction, in the opposite direction of arrow 17. Thus, both connectors 12, 13 are sealed relative to each other by seal 27.

In accordance with the deformability necessary for functionality, seal 27 is made of a soft, elastic material, so that given vibrational stresses of plug connection 11, the seal is not able to prevent undesired relative movements between coupled connectors 12, 13 due to vibrational stresses and due to the different masses of both connectors 12, 13.

To rigidly couple connectors 12, 13 also under vibrational stresses, a first pressing element 31 and-a second pressing element 32 are provided. First pressing element 31, which is represented in the figures in a superelevated manner, is formed as a circumferential protuberance of contact carrier 15, which is made of an inherently stable plastic, and forms one piece with the contact carrier. In this context, the pressing element protrudes from a sidewall 33 of contact carrier 15 in a radial direction and partially projects into receiving slot 24 such that when inserting flange 26 into receiving slot 24, the pressing element is radially pressed against side surface 29 in the end segment of flange 26.

Alternatively, the circumferential extent of first pressing element 31 can be partially interrupted and can form single pressing regions, the pressing regions also being able to be re-formed into individual pressing points, so-called pressing warts.

Second pressing element 32 is situated at the closed end of receiving slot 24 and is formed as a circumferential ring having rectangular cross-sectional areas. Second pressing element 32 is made of a hard rubber and has a Shore hardness of at least 60. At the end of the coupling operation of both connectors 12, 13, second pressing element 32 receives an end face 34 at the free end of flange 26 under axially directed pressing tension.

As a result of pressing elements 31, 32, both connectors 12, 13 are radially as well as axially biased relatively to each other after the completed coupling process. In this manner, both connectors 12, 13 form a one-piece unit, which can, however, be detached as needed. This one-piece design (integral formation) transfers to contact elements 18 and contact parts 21, which are situated in connectors 12, 13, and whose connection is fixed in the same manner.

As a result of contact elements 18 being connected in a stable manner to contact parts 21, functionality-threatening relative movements between contact elements 18 and contact parts 21 in response to vibrational stresses acting on plug connection 11 are reduced to being uncritical, so that plug connection 11 remains functionally stable even under these unfavorable operating conditions. As a result, it is possible to attach plug connection 11 directly to an aggregate of an internal combustion engine.

What is claimed is:

1. An electrical plug connection comprising:

first and second connectors adapted to be detachably coupled to one another in an axially running plug direction, the first connector including a housing;

a receiving slot formed in the housing of the first connector;

a flange protruding at the second connector, the flange at least regionally engaging with the receiving slot when the first and second connectors are coupled, the flange having an end face and having a side surface;

a seal attached to the first connector, the seal being elastically deformed by the flange when the first and second connectors are coupled;

at least one first pressing element radially pressed against the side surface of the flange when the first and second connectors are coupled, the first pressing element projecting radially, transversely to the plug direction, into the receiving slot; and at least one second pressing element receiving the end face of the flange under axially directed pressing tension at an end of a coupling operation of the fist and second connectors, the second pressing element being situated in the receiving slot.

2. The plug connection according to claim 1, further comprising a contact carrier, and wherein the first pressing element forms one piece with the contact carrier as part of the housing of the first connector and is composed of an inherently stable plastic.

3. The plug connection according to claim 2, wherein the first pressing element extends around the contact carrier.

4. The plug connection according to claim 2, wherein a circumferential extent of the first pressing element at the contact carrier is partially interrupted and forms individual pressing regions that can alternatively be re-formed into individual pressing points.

5. The plug connection according to claim 2, wherein the second pressing element is situated at a closed end of the receiving slot and is formed in the contact carrier as a circumferential ring composed of an elastic material having a Shore hardness of at least 60.

6. The plug connection according to claim 5, wherein the second pressing element is formed from hard rubber.

* * * * *